US010245461B2

(12) United States Patent
Bruni et al.

(10) Patent No.: US 10,245,461 B2
(45) Date of Patent: Apr. 2, 2019

(54) STRENGTH TRAINING SYSTEM AND METHOD OF USING SAME

(71) Applicants: Dave Peter Bruni, Lincoln, CA (US); Kelly Ann Bruni, Lincoln, CA (US)

(72) Inventors: Dave Peter Bruni, Lincoln, CA (US); Kelly Ann Bruni, Lincoln, CA (US)

( * ) Notice: Subject to any disclaimer, the term of this patent is extended or adjusted under 35 U.S.C. 154(b) by 183 days.

(21) Appl. No.: 15/460,116

(22) Filed: Mar. 15, 2017

(65) Prior Publication Data

US 2017/0266480 A1 Sep. 21, 2017

Related U.S. Application Data

(60) Provisional application No. 62/309,385, filed on Mar. 16, 2016.

(51) Int. Cl.

| | |
|---|---|
| ***A63B 21/00*** | (2006.01) |
| ***A63B 21/062*** | (2006.01) |
| ***A63B 21/078*** | (2006.01) |
| *A63B 23/04* | (2006.01) |
| *A63B 71/00* | (2006.01) |

(52) U.S. Cl.

CPC ..... *A63B 21/0783* (2015.10); *A63B 21/062* (2013.01); *A63B 21/0624* (2015.10); *A63B 21/4035* (2015.10); *A63B 21/4045* (2015.10); *A63B 2023/0411* (2013.01); *A63B 2071/0063* (2013.01); *A63B 2071/0072* (2013.01)

(58) Field of Classification Search

CPC ..... A63B 21/078; A63B 21/0783; A63B 21/072–21/08

See application file for complete search history.

(56) References Cited

U.S. PATENT DOCUMENTS

| | | | |
|---|---|---|---|
| 1,956,498 | A | 4/1934 | Duke |
| 3,235,255 | A | 2/1966 | Leflar |
| 3,384,370 | A | 5/1968 | Bailey et al. |
| 3,640,529 | A | 2/1972 | Kane |
| 4,271,543 | A | 6/1981 | Martin |
| 4,302,009 | A | 11/1981 | Johnson |
| 4,441,706 | A | 4/1984 | Korzaniewski |
| 4,471,956 | A | 9/1984 | Marlo |
| 4,527,797 | A | 7/1985 | Slade, Jr. et al. |
| 4,529,194 | A | 7/1985 | Haaheim |
| 4,585,229 | A | 4/1986 | Brasher |

(Continued)

FOREIGN PATENT DOCUMENTS

| | | | |
|---|---|---|---|
| CN | 202724544 | U | 2/2013 |

*Primary Examiner* — Nyca T Nguyen

(74) *Attorney, Agent, or Firm* — Proven Patents Law Firm; Kregg A. Koch

(57) ABSTRACT

An exercise system having a pair of stationary support members, each having a lower portion and an upper portion, the upper portion being at an acute angle relative to the lower portion. Some embodiments have a pair of rotatable support members configured to rotate between a first position wherein the first rotatable support member is generally adjacent to the upper portion of the stationary support members and a second position wherein the first rotatable support member is generally adjacent to the lower portion of the stationary support members. Some embodiments have a first and a second carriage member translatable along at least a portion of the rotatable support members and a barbell coupled with the first and second carriage members.

20 Claims, 7 Drawing Sheets

(56) References Cited

U.S. PATENT DOCUMENTS 4,615,524 A 10/1986 Sutherland
4,618,142 A 10/1986 Joseph, Jr.
4,618,143 A 10/1986 Twardosz
4,648,595 A 3/1987 Selle
4,662,229 A 5/1987 Curtis
4,749,188 A 6/1988 Montgomery
4,795,149 A * 1/1989 Pearson ..... A63B 21/078 482/133
4,867,444 A 9/1989 Castillo
4,875,676 A 10/1989 Zimmer
4,934,693 A 6/1990 Santoro
4,953,857 A 9/1990 Lemire
4,958,833 A 9/1990 Stater
4,960,277 A 10/1990 Larossa et al.
4,973,050 A 11/1990 Santoro et al.
5,039,090 A 8/1991 Roosevelt
5,046,725 A 9/1991 Brennan
5,050,868 A 9/1991 Pearson
5,078,392 A 1/1992 Kracht
5,087,032 A 2/1992 Gresh
5,141,480 A 8/1992 Lennox et al.
5,151,072 A 9/1992 Cone et al.
5,152,731 A 10/1992 Troutman
5,184,992 A 2/1993 Banks
5,215,510 A * 6/1993 Baran ..... A63B 21/078 482/104
5,217,421 A 6/1993 Chrysler
5,273,506 A 12/1993 Dawson, Jr.
5,281,193 A 1/1994 Colbo, Jr.
5,449,333 A 9/1995 Carter
5,509,876 A 4/1996 Reyes
5,665,036 A 9/1997 Hsieh
5,669,859 A 9/1997 Liggett et al.
5,716,306 A 2/1998 Gallay
5,725,459 A 3/1998 Rexach
5,795,003 A 8/1998 Nerger et al.
5,971,898 A 10/1999 Schoolfield
6,010,436 A 1/2000 Obery et al.
6,042,516 A 3/2000 Norton
6,106,439 A 8/2000 Boland
6,224,518 B1 5/2001 Weiss et al.
6,264,589 B1 7/2001 Chen
6,299,568 B1 10/2001 Prok
6,450,927 B1 9/2002 Ellils
6,623,409 B1 9/2003 Abelbeck
6,652,420 B2 11/2003 Chen
7,056,268 B2 6/2006 Emick
7,066,866 B1 6/2006 Mobley
7,086,999 B2 8/2006 Jeneve et al.
7,090,623 B2 8/2006 Stewart et al.
7,094,186 B2 8/2006 Diakonov et al.
7,226,400 B1 6/2007 Gedeon-Janvier
7,353,573 B2 4/2008 Anscher
7,374,516 B2 5/2008 Lundquist
7,393,309 B2 7/2008 Webber
7,455,629 B2 11/2008 Abelbeck
7,549,950 B1 6/2009 Lundquist et al.
7,591,771 B2 9/2009 Rullestad et al.
7,691,040 B1 4/2010 Schwinghamer
7,727,129 B1 6/2010 Goddard
7,892,158 B2 2/2011 Varga
7,909,743 B1 3/2011 Webber
8,047,972 B1 11/2011 Dean et al.
8,075,458 B2 12/2011 Nalley
8,092,353 B2 1/2012 Yang et al.
8,128,541 B2 3/2012 Hartman
8,172,731 B1 5/2012 Bredda
8,231,509 B2 7/2012 Lundquist
8,328,698 B1 12/2012 Webber et al.
8,465,398 B2 6/2013 Lee et al.
8,475,343 B2 7/2013 Hinds et al.
8,475,346 B2 7/2013 Gerschefske et al.
8,512,212 B2 8/2013 Ish, III
8,517,900 B1 8/2013 Britt
8,568,281 B2 10/2013 Beaulieu et al.
8,740,760 B2 6/2014 York et al.
8,834,329 B2 9/2014 Kelly
9,011,298 B2 4/2015 Bonomi
9,067,102 B2 6/2015 Poppinga
2002/0016239 A1 2/2002 Slawinski et al.
2002/0147081 A1 10/2002 Slawinski et al.
2003/0134722 A1* 7/2003 Greenland ..... A63B 21/06 482/100
2006/0040800 A1 2/2006 Slyter
2006/0100075 A1 5/2006 Harsh
2006/0276314 A1 12/2006 Wilson et al.
2007/0042876 A1 2/2007 Lundquist
2007/0203002 A1 8/2007 Webber
2009/0264267 A1 10/2009 Ballif
2009/0286658 A1 11/2009 James
2010/0130335 A1 5/2010 Hoobler
2011/0230316 A1 9/2011 Johnson, III
2011/0301000 A1 12/2011 Pullen
2012/0094812 A1 4/2012 Smiley
2012/0238416 A1 9/2012 Becker
2012/0309597 A1 12/2012 Liu
2013/0035218 A1 2/2013 Wierszewski
2013/0065738 A1 3/2013 Henniger et al.
2014/0121073 A1 5/2014 Hardy
2014/0128228 A1* 5/2014 Bonomi ..... A63B 21/0414 482/98
2015/0306443 A1 10/2015 Bruni, Jr. et al.

* cited by examiner

STRENGTH TRAINING SYSTEM AND METHOD OF USING SAME

PRIORITY CLAIM

The present application claims priority from U.S. Patent Application No. 62/309,385, filed on Mar. 16, 2016, the content of which is incorporated by reference herein in its entirety. The benefit of priority is claimed under the appropriate legal basis including, without limitation, under 35 U.S.C. § 119(e).

BACKGROUND OF THE DISCLOSURE

Field of the Disclosure

The disclosure relates to weightlifting rack systems, in particular, weightlifting rack systems having slidable rail supports.

Background and Description of the Related Art

Sliding weightlifting rack supports are typically in a fixed angular orientation.

The population has become more aware of the health benefits of exercise and personal fitness. People make going to the gym, fitness club or having a home gym an element of their physical fitness and supplement this physical fitness with lifting weights. A concern regarding the practice of weight lifting has been having a spotter present during the lifting. A user could potentially injure himself or herself by lifting too much weight or accidentally dropping weight on a body part. The spotter's purpose is to help the user finish lifting the weight after the user has become fatigued, or remove the weight should the user not be able to complete the exercise repetition. Many people, however, do not always have spotters available.

To address this issue, Smith machines have been introduced as a way for a user, without a spotter, to lift weights with the added safety of being able to rack the weights at any time during the exercise and to reduce the risk of losing one's balance during the exercise, which can be more difficult when using a free weight barbell (also referred to herein as a bar). The typical Smith machine has a frame with a pair of stationary guide rails. A barbell is attached to these guide rails so that a user can lift the barbell in a vertical up and down motion. Exercises that can be performed on these Smith machines include chest press, shoulder press, leg squats, cleans, bicep curls and triceps extensions.

A major restriction of the Smith machine that guide rails or tracks of the Smith machine are typically in a fixed position and/or angular orientation. Traditional Smith machines require the user to lift the weight in a fixed, vertical up and down orientation. This inhibits the user from lifting the barbell in a full range of motion that can otherwise be accomplished with a barbell, in which the barbell is unrestricted in terms of movement directions. The horizontal freedom of movement associated with a barbell allows for a more natural lifting motion. The horizontal movement limitation of traditional Smith machines can also result on excessive shoulder joint strain during exercise. As such, there is a need for a weightlifting system that provides the user the ability to lift weights in a wider range of motion than with traditional Smith machines with the incorporation of safety of guide rails and ability to rack the weights when the user cannot support the weight himself or herself, for additional safety to the user.

SUMMARY OF SOME EMBODIMENTS

Some embodiments disclosed herein relate generally to strength training or weightlifting machines. For example and without limitation, some embodiments disclosed herein relate to a free weight simulating weightlifting system that allows the user to lift weights in a greater range of motion with additional safety support than traditional weightlifting machines or equipment. Additionally, some embodiments disclosed herein can result in reduced shoulder joint pressure to the user.

Some embodiments of the weightlifting system disclosed herein are configured to allow the user to lift weights in a wider range of motion while reducing shoulder joint pressure and having additional support safety, having a support base or frame with a first side and a second side. The system can have a first guide rail and a second guide rail that pivotably or rotatably attach to the support base. The first guide rail and second guide rail can be configured to pivot about a shaft or axis located generally at the bottom portion or lower half of the guide rail. The guide rails can be configured to permit a bar to slide or translate generally in the upward and downward relative to the guide rails, while also simultaneously permitting the guide rails to rotate or pivot about the axis.

Some embodiments of the present disclosure relate to a free weight simulating, weightlifting system configured to allow the user to lift weights in a full range of motion while reducing shoulder joint pressure and having additional support safety. The system has a support base, sides that define the exercise area and guide rails that pivotably attach to the support base and bar.

Some embodiments of the weightlifting system can have a support base, the support base or frame comprising a first side and a second side portion, a first guide rail, and a second guide rail wherein the first guide rail and second guide rail pivotably or rotatably attach to the support base. The first guide rail and second guide rail can be configured to have a barbell that slides up and down the first guide rail and second guide rail. In some embodiments, the weightlifting system can further comprise a pair of hand grips wherein the pair of hand grips movably attach to the barbell. In some embodiments, the weightlifting system can further have a horizontal barbell assembly comprising a first rail bracket and a second rail bracket movably affixed to the first guide and rail second guide rail. The first rail bracket and the second rail bracket can be attached to the barbell.

In some embodiments, the weightlifting system can further comprise a plurality of wheels wherein the plurality of wheels can rotatably affix to the first rail bracket and the second rail bracket and engage the first guide rail and second guide rail. Additionally, the system can have a first guide rail stop and a second guide rail stop, wherein the first guide rail stop and the second guide rail stop are affixed to the support base.

In some embodiments, the weightlifting system can further have a first bumper and a second bumper wherein the first bumper and the second bumper affix to a bottom end of the first guide rail and the second guide rail. The system can further have a plurality of bar hooks wherein the bar hooks are attached to the barbell. The system can further have a plurality of support base notches wherein the plurality of bar hooks engage the support base notches.

Some embodiments disclosed herein relate to a weightlifting system, having one or more rotating support arms that can support carriage members along the length of the rotating support arms. The rotating support arms can be rotatable relative to a fixed arm support. In any embodiments disclosed herein, the support arms can have internal guide rails or carriage members configured to translate along an internal surface of the support arm in the lengthwise direction (which is generally upward and downward, though this may not be in the true vertical direction, because the support arms are rotatable). The weightlifting system can have a bar that extends at least between the two support arms that a user can grip or support. The bar can extend beyond the two support arms so that one or more weight plates can be supported by the bar. The weights can be loaded onto the end portions of the bar, the end portions extending outwardly from the support rails. The weightlifting system can have a latch mechanism used to secure the bar in a desired or predetermined position along the length of the support arms. In the secured position, the bar will be prevented from translating at least in the downward direction until the latch mechanism is disengaged or changed to the free position.

Additionally, in any embodiments disclosed herein, the bar of the weightlifting system can have slidable grip elements or handle elements that are slidable along the axial length of the bar. In any embodiments disclosed herein, the grip elements can be configured such that they slide axially along the length of the bar, but do not rotate about the bar. Conversely, the grip elements can be configured to slide and rotate about the bar.

Described herein is a weightlifting machine having a plurality of safety features for weightlifting, and/or features that can reduce the load exerted on a user's shoulders during bench press exercise. For example, during a squat routine for exercising one's leg muscles, the weightlifting system can be configured to limit the movement of the bar in the lateral directions (left and right, relative to the user's forward facing position). The weightlifting system can also be configured to provide a fixed range of movement of the bar in the forward and aft directions.

It should be noted that any of the features, components, or details of any of the arrangements or embodiments disclosed in this application, including those disclosed below, are interchangeably combinable with any other features, components, or details of any of the arrangements or embodiments disclosed herein to form new arrangements and embodiments.

BRIEF DESCRIPTION OF THE DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

DETAILED DESCRIPTION

Figure 1:
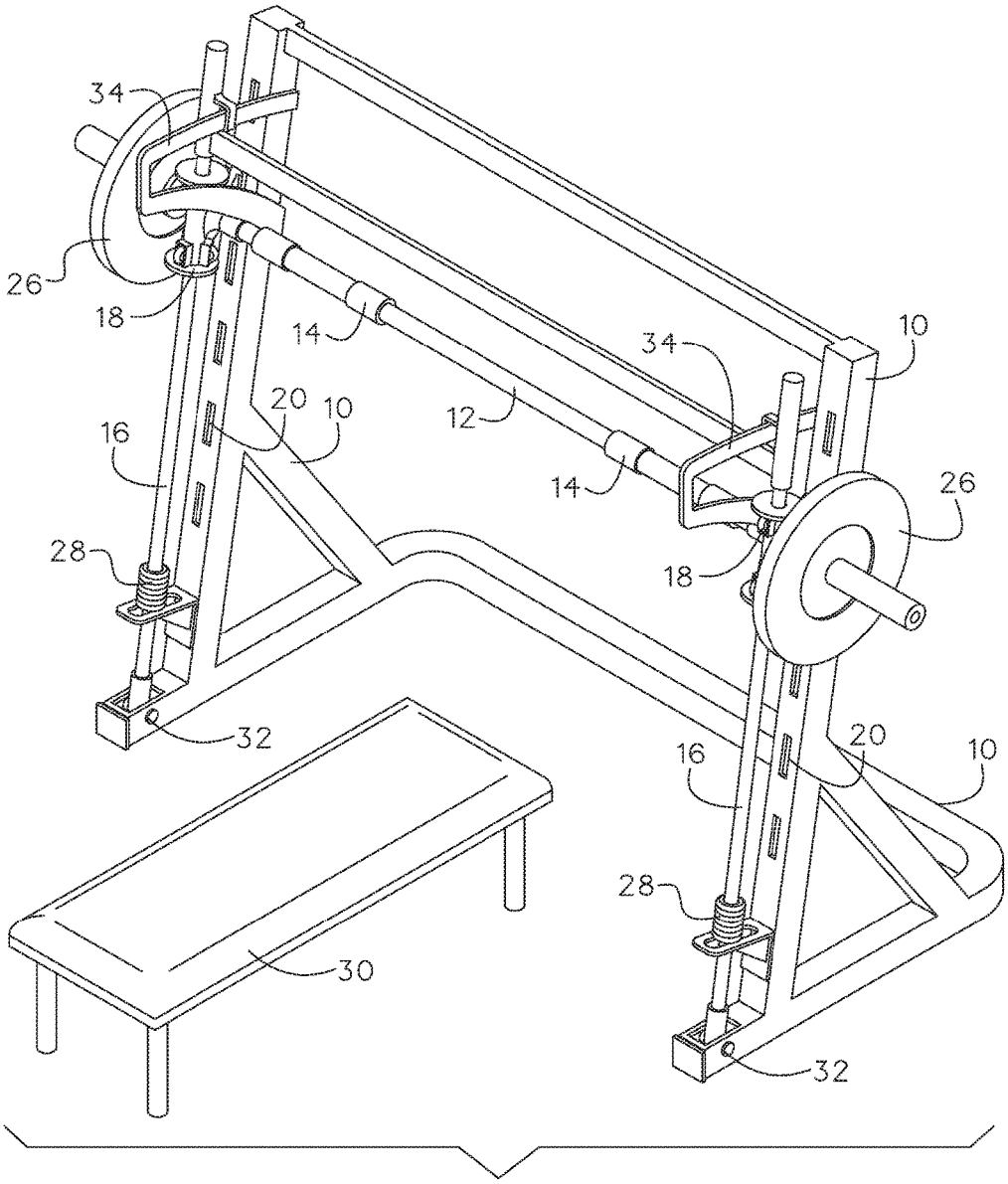
FIG. 1 shows a perspective view of one embodiments of the present Invention.

Embodiments disclosed herein relate to strength training or weightlifting systems. FIG. 1 shows an embodiment of a weightlifting system 1. As shown in FIG. 1, some embodiments of the weightlifting system can comprise a support base 10. In some embodiments, the support base can be configured to define the exercise area. The support base can comprise a rigid frame, which can be made from metal, such as steel. The weightlifting system can have a barbell, which can be an Olympic sized barbell, or can be any desired size or configuration. In some embodiments, the barbell can weigh as little as 15 or 20 pounds, or less, or can weigh approximately 45 or 50 pounds, and can be sized and configured to support up to 1,000 lb or more of weight loaded onto the barbell. In alternative embodiments, the barbell can have a weight of approximately 45 pounds. The barbell can be made from metal, such as steel.

Figure 2:
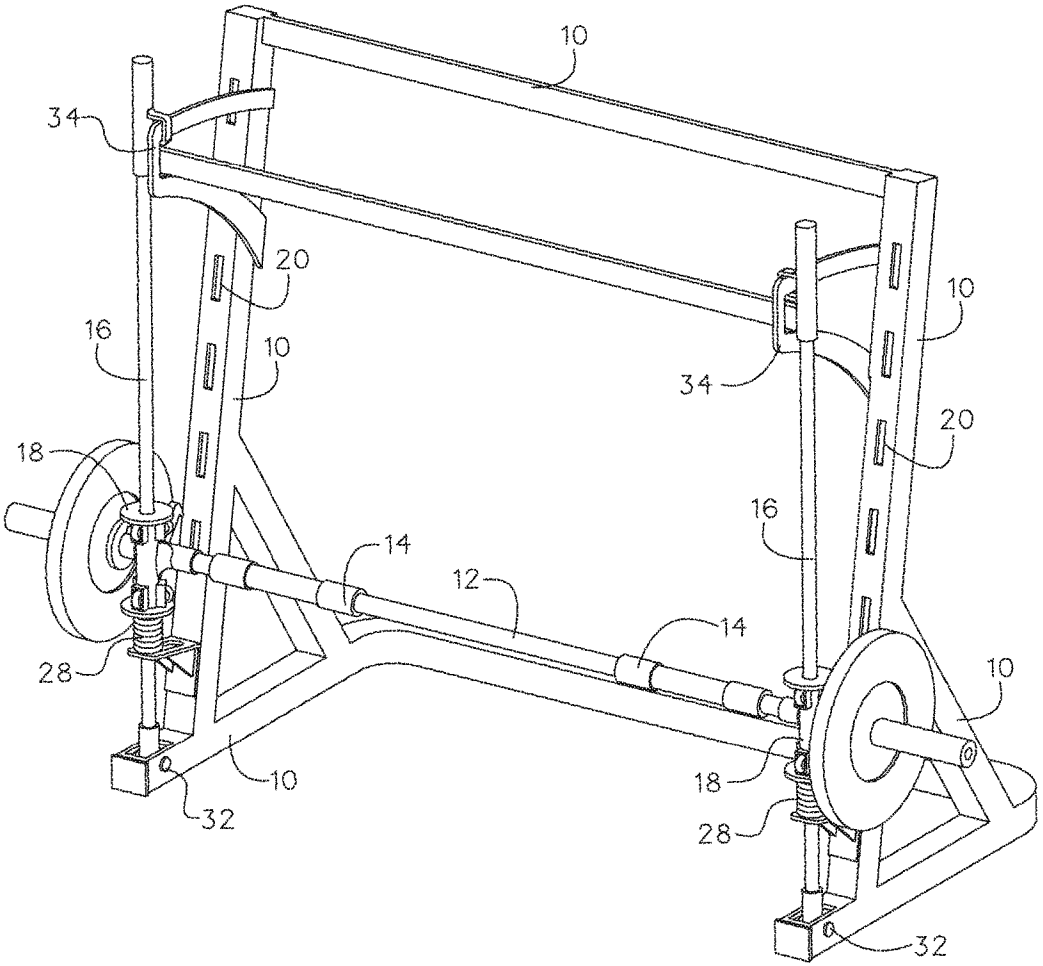
FIG. 2 shows a perspective view of the invention omitting item 30 bench for illustrative purposes and to demonstrated one embodiment of the present invention, shown in use.
Figure 3:
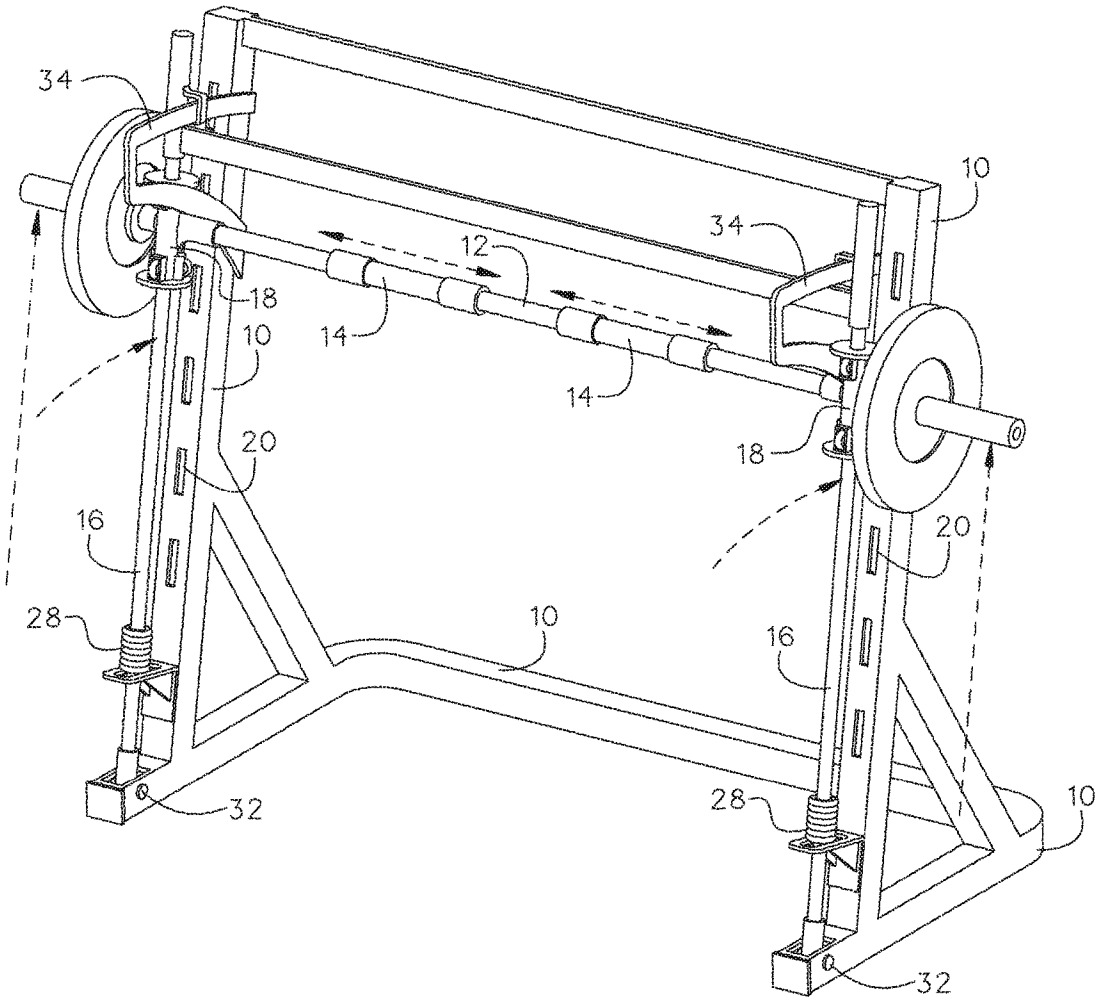
FIG. 3 shows a perspective view of one embodiment of the present invention, shown in use.

In any embodiments disclosed herein, though not required, the weightlifting system embodiments can have a pair of slidable or moveable grip elements 14 (also referred to herein as hand grips) supported by the barbell. As shown in FIGS. 1-3, the grip elements in some embodiments can be slidable or translatable along the length of the barbell. The grip elements can comprise a slidable range of approximately 8 inches, or from approximately 1 inch to approximately 12 inches or more.

In any embodiments disclosed herein, the grip elements can have a plurality of ball bearings or slide element positioned between an inner wall portion of the grip elements and an outer wall of the barbell, the bearings or slide element configured to provide smooth rolling or translation along the length of the barbell. The grip elements can generally be made from metal, plastic, rubber, or any combination thereof. For example, the grip elements can be made from metal sleeves (which can be aluminum, steel, or otherwise) that have bearings therein to permit the grip elements to slide or translate along the length of the outer surface of the barbell, and a gripping portion made of plastic and/or rubber, for additional grippiness and/or comfort. Each grip or grip element can have a first linear bearing or slide element at a first end thereof, and a second linear bearing or slide element at a second end thereof.

In any embodiments disclosed herein, the grip elements can be configured to translate along the length of the barbell independently, and can be configured to translate along the length of the barbell without being rotatable about the barbell. In some embodiments, the barbell and/or grip elements can have indexing features, channels, protrusions, and/or other features that permit the translation of the grip elements along the length of the barbell, but prevent the rotation of the grip elements relative to the barbell. Alternatively, in any embodiments, the grip elements can also be configured to generally freely rotate relative to the barbell in addition to translating lengthwise along the barbell.

In some embodiments, the grip elements can have a middle portion, a first end portion, and a second end portion. The middle portion can be configured to receive a user's hand. The middle portion can be knurled or otherwise have features, materials, or components such as a rubber or foam sleeve or overmold designed to provide a slip resistant and/or comfortable grip for the user.

In any embodiments, the middle portion can have an outer diameter of approximately 1.625 in, or from approximately 1.5 in to approximately 1.75 inches. The middle portion can be approximately 5 inches long, or from approximately 4.5 inches to approximately 5.5 inches long. Each of the first and the second end portions can be configured to support a linear bearing or other slide element therein. A retaining ring or clip can be used to secure the bearings or slide elements therein. The overall length of the grip elements can be approximately 10 inches, or from approximately 8 inches to approximately 12 inches, or from approximately 9 inches to approximately 11 inches.

Any embodiment of the weightlifting system disclosed herein can have two grip elements. Additionally, in any embodiments disclosed herein, the grip elements can have locking features or locking element configured to selectively lock the grip elements either rotationally, translationally, or both rotationally and translationally. For example, with the lock activated, the grip elements can be securely positioned in a desired location along the length of the barbell, or so as to be rotationally locked to the barbell. The locking element can be activated by hand without the use of tools, or, in other embodiments, using tools. In some embodiments, the locking element can comprise a quick release clamp, spring clamp, or other type of clamp, or any of the features, components, or details of the limiting elements described herein.

In any embodiments disclosed herein, a locking collar or limiting element can be secured to the barbell in any desired position to provide a limit to a range of movement of the hand grips or grip elements. The limiting element can be positioned at any desired location along the length of the barbell, or multiple limiting elements can be positioned at any desired locations along the length of the barbell. For example, in any embodiments, one, two, or four limiting elements can be positioned at any desired positions along the length of the barbell to limit the range of movement of the grip elements. In embodiments where one limiting element is positioned on the barbell, the limiting element can be positioned in approximately the middle of the length of the barbell.

In any embodiments, the limiting element or elements can be selectively fixable or lockable in any desired position along the length of the barbell. For example, the locking element can be clampable by hand (i.e., without the use of tools) to the barbell at any desired position. A quick release type clamping element (having a cam lever or otherwise) can be used to selectively lock or secure the limiting element in the desired position. When the limiting element is to be moved, the user can simply release the clamp, reposition the limiting element in the desired position, and then engage the clamp. Other locking or securing mechanisms can be used to secure the limiting element in the desired position, such as set screws (hand or tool operated), ball and detent components, spring collars, slip lock collars, and other quick release collars that are typically used with barbells, or otherwise.

In some embodiments, with reference to FIGS. 1-4, the barbell can be configured to translate or slide generally up and down along a first guide rail and a second guide rail herein referred to as guide rails 16. In some embodiments, the guide rails can be configured to pivotally attach to the support base. The guide rails can be configured to pivotally attach to the support base at pivot points 32. In some embodiments, pivot points comprise a bolt or shaft about which the guide rails can rotate, and which can also be used to couple the guide rails to the support base. The guide rails can be made from any suitable material, including metal. In some embodiments, the guide rails comprise steel or stainless steel. In alternative embodiments, the guide rails can comprise aluminum.

Figure 4:
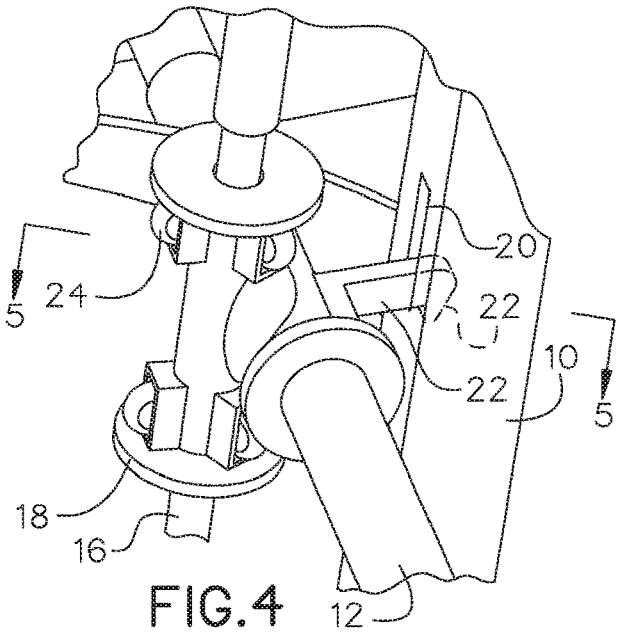
FIG. 4 shows a perspective view of one embodiment of the present invention, in a locked configuration.

Any of the weightlifting system embodiments disclosed herein can have a horizontal barbell assembly 18 configured to movably attach the barbell to the guide rails. In some embodiments, referring to FIG. 4, the horizontal barbell assembly can comprise an engagement element 22, also referred to as a bar hook, or a pair of engagement elements 22. The engagement elements 22 can each be configured to advance into and engage with any one of a plurality of openings 20 (also referred to herein as apertures or recesses) formed in the support base on each side of the barbell assembly. The engagement element or elements can be moved between a secured position (in which the engagement elements are advanced into the openings 20 or otherwise secured to the base support or support arm of the base support), as shown in FIG. 4, and a free position in which the engagement elements do not secure the barbell assembly to the base support or support arm of the base support. The engagement elements can be moved from the free position to the secure position by rotating the barbell in the direction A1 shown in FIG. 4. This will cause the engagement elements to advance into the openings 20 formed in the support arm for the base support 10. Rotating the barbell in the opposite direction will cause the engagement elements to change from the secured position or state to the free position or state and permit the barbell assembly to move up and down relative to the guide rails.

The engagement elements can be made from metal, including steel, aluminum, or any other suitable material or materials. In some embodiments, a plurality of protrusions can extend from the support base to secure or rack the barbell. In alternative embodiments, the plurality of protrusions can be made from metal, including steel, aluminum, or any other suitable material or materials.

Figure 5:
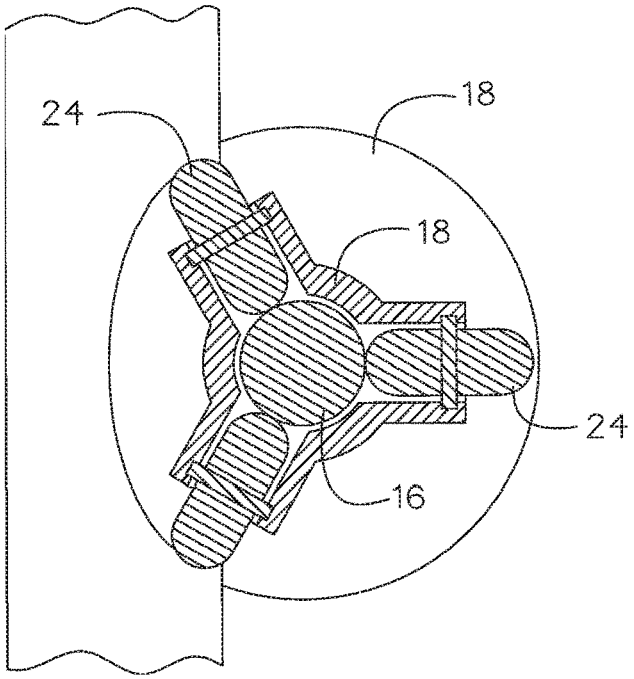
FIG. 5 shows a section detail view of one embodiment of the present invention along line 5-5 in FIG. 4.

In any embodiments disclosed herein, with reference to FIGS. 4 and 5, the weightlifting system can have a horizontal barbell assembly having a plurality of wheels 24 (which can comprise three, four, eight, or more wheels) configured to roll about a length of the guide rails 16 and secure the barbell assembly to the guide rails in every radial direction relative to the guide rails 16 by contacting and rolling against an outside surface of the guide rails 16. Linear bearings made of plastic, metal, or other suitable materials can also be used. In some embodiments, the plurality of wheels can be configured to be attached to a wheel housing unit that can be movable along the length of the guide rails 16. The wheel housing unit can be configured so that the plurality of wheels are removable so that such wheels can be interchanged and/or replaced when needed. In any embodiments, the plurality of wheels can have rubber surfaces or otherwise be made from rubber, plastic, or any other suitable material or combination of materials, including polyurethane.

As shown in FIG. 1, any embodiments of the weightlifting systems disclosed herein can have bottom support members or bumpers 28 or otherwise be configured to limit the vertical range of movement of the barbell. The support members 28 can be made from rubber or any other resilient material, or otherwise, and can improve the safety of the equipment by providing a support for the barbell assembly when the user can no longer support the weight of the barbell assembly with his or her own strength. As such, in some embodiments, the support members 28 can be configured to limit or stop the downward movement of the barbell and horizontal barbell assembly at a bottom end of the guide rails or at any desired or predetermined position along the height of the guide rails, depending on the position of the support members 28. In any embodiments, the support members 28 can be configured to be attached to the base of the support base. In any embodiments disclosed herein, the support members 28 can be secured at any desired position along the height of the guide rails. This can be achieved by positioning the support members in any of plurality of openings, recesses, or other features formed in the frame or support members, such as but not limited to openings 20. In some embodiments, the bumpers can comprise metal springs. In alternative embodiments, the bumpers can comprise rubber, springs, plastic, and/or any combination of the foregoing materials or components. The bumpers or support members 28 can be configured to soften the impact of the barbell against the support members, to increase the safety of the equipment and/or to reduce damage to the equipment during impact from the barbells.

In any of the weightlifting system embodiments disclosed herein, the weightlifting system can be configured to limit a range of rotation of the guide rails. For example, with reference to FIG. 1, some embodiments of the weightlifting system can have guide rail stops 34 configured to restrict the rotation of the guide rails 16 to a predetermined angular range or displacement relative to the support base 10. In some embodiments, the guide rail stops can be configured to be attached to the support base 10 at or adjacent to a top end of the support base 10. In alternative embodiments, the guide rail stops can be configured to engage the guide rails. In some embodiments, the guide rail stops can be configured to engage the guide rails at range of 0 degrees to 180 degrees from the top end of the support base. In alternative embodiments, the guide rail stops can be configured to engage the guide rails at 90 degrees from the top end of the support base. The guide rail stops can be in the form of a bracket that provides a mechanical stop or limit to a range of movement of the guide rails. For example, the guide rail stops can be configured such that, when the guide rails rotate against a limiting surface of the guide rail stops, the guide rails are prevented from rotating any further.

In any embodiments disclosed herein, the guide rail stops can be configured to prevent the guide rails from rotating past the vertical (or 0°) position, or can be configured to prevent the guide rails from rotating more than 5° past the vertical position. In some embodiments, the guide rail stops can be made from metal such as steel or aluminum, or can be made from any other suitable material.

In any embodiments disclosed herein, as shown in FIG. 1, the weight lifting system can comprise a bench 30, which can be a flat bench, an incline bench, a decline bench, a 90 degree bench, a seat, or any other adjustable or suitable bench or seat. The weightlifting system can be configured such that the bench can be movable relative to the support base 10, or can be removably or selectively securable to the support base 10 for additional safety and/or security to the user.

Figure 6:
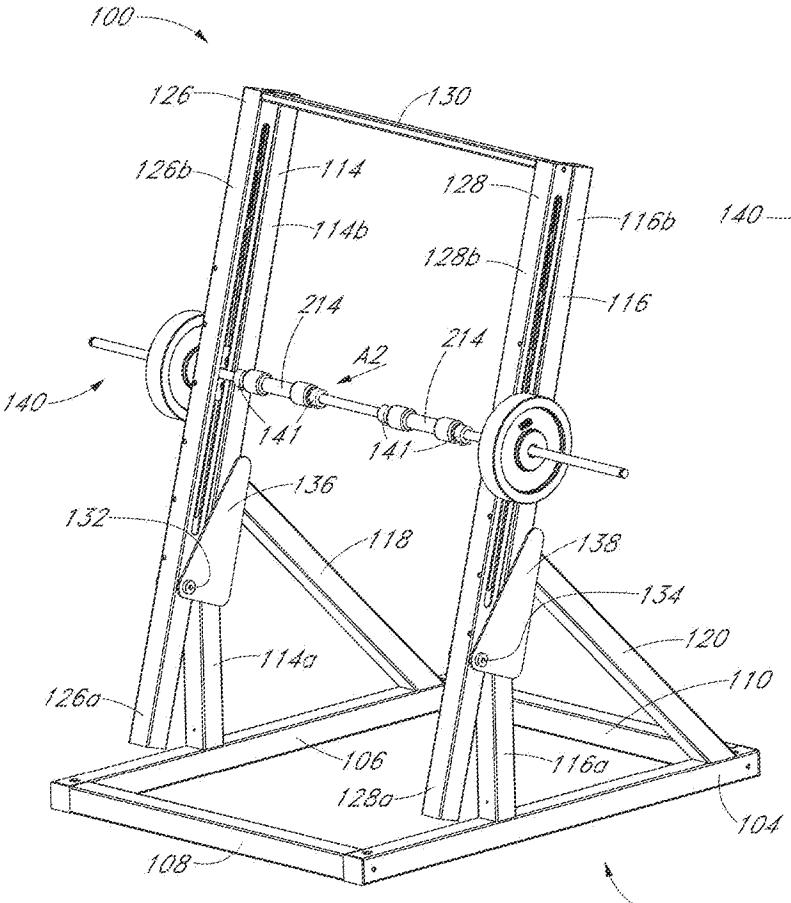
FIG. 6 is a perspective view of another embodiment of a weightlifting system of the present disclosure, showing the weightlifting system in a first, or stowed (also referred to as a locked) state.

FIG. 6 shows another embodiment of a weightlifting system 100. Any embodiments of the weightlifting system 100 can have any of the features, components, materials, sizes, and/or other details of any of the embodiments of the weightlifting systems disclosed or shown herein, including weightlifting system 1, or any of the other embodiments disclosed herein, in combination with or in place of any of the features, components, materials, sizes, and/or other details of the weightlifting system 100 described herein. Additionally, any of the embodiments of the weightlifting system 1 can have any of the features, components, materials, sizes, and/or other details of any of the embodiments of the weightlifting system 100 disclosed or shown herein, in combination with or in place of any of the features, components, materials, sizes, and/or other details disclosed for the weightlifting system 1.

With reference to FIG. 6, the weightlifting system can have a support base or frame 102 that can comprise a pair of forward extending support members 104, 106 (also referred to herein as side frame members), and a pair of laterally extending support members 108, 110 (also referred to herein as front and rear frame members, respectively). The support members 104, 106 can be approximately 60 inches in length, or from approximately 50 inches or less to approximately 70 inches or more in length. The laterally extending support members 108, 110 can be approximately 43.13 inches in length, or from approximately 35 inches or less to approximately 55 inches or more in length.

The support base 102 can also have a first stationary support member 114 (also referred to herein as a first stationary support arm) and a second stationary support member 116 (also referred to herein as a second stationary support arm) extending generally upwardly away from the forward extending support members 104, 106. In any embodiments disclosed herein, the first stationary support arm can have a first portion 114*a* (also referred to herein as a lower portion) that is generally vertically oriented and a second portion 114*b* that has an angle that is approximately 15° relative to vertical, or from approximately 10° to approximately 20° or more from vertical.

The support base can also have a first and a second angled support members 118, 120 that can span between the first and second forward extending support members 104, 106 and the first and second stationary support members 114, 116, respectively. The first and second angled support members 118, 120 can be approximately 43.11 inches in length, or from approximately 35 inches or less to approximately 55 inches or more in length. An end portion of the angled support members adjacent to the forward extending support members can be angled at approximately 45°. An end portion of the angled support members adjacent to the stationary support members can be angled at approximately 30°. Except otherwise described, the members of the support base can be bolted, welded, or otherwise coupled together.

The first and second portions of the first stationary support arm 114 can be monolithically formed, or can be formed of different tubing members and welded, bolted, or otherwise coupled together. For example, FIG. 10 first stationary support arm 114. The first stationary support arm 114 or any stationary support arm disclosed herein can have a bend 114*d* between the first portion 114*a* and the second portion 114*b* of the first stationary support arm 114. The bend can be an approximately 15° bend, or can be from approximately 10° to approximately 20° or more. Additionally, the first and second portions of the first stationary support arm 114 can be separately formed and can be welded or otherwise joined together. In that arrangement, the ends of the first portion 114*a* and the second portion 114*b* can have an angled cut end each being approximately 7.5°, or from approximately 5° to approximately 10°.

The first portion 114*a* can be approximately 18.67 inches long, or from approximately 15 inches to approximately 25 inches long. The second portion 114*b* can be approximately 54.67 inches long, or from approximately 45 inches to approximately 60 or more inches long. The first portion 114*a* can serve as a rotational stop or limit for the first rotatable member 126, to prevent the first rotatable member from rotating beyond a predetermined angle relative to the first stationary member 114. For example, the first portion 114*a* can prevent the first rotatable member 126 from rotating past the vertical orientation, or more than approximately 2°, or approximately 5° past the vertical orientation of the first rotatable member. The second stationary support arm 116 can be similarly configured to have a first portion 116*a* and a second portion 116*b*.

In any embodiments disclosed herein, the support base can be configured such that the support base is rigid enough to not need the front and/or rear frame members. For example and without limitation, a top frame member or plurality of frame members, not shown, can be used to interconnect or couple a top portion of the first stationery support arm 114 to a top portion of the second stationery support arm 116 to provide additional, rigid frame support to the first and second stationery support arms. In this configuration, the rigidity of the frame can be significantly increased such that the laterally extending support members 108, 110 can be eliminated to provide free access to the barbell without obstruction.

Any embodiments of the weightlifting system disclosed herein can have a first rotatable member 126 and a second rotatable member 128 that can rotate about a fixed axis relative to the first and/or second stationary support members 114, 116. In some embodiments, the first and second rotatable members 126, 128 can be approximately 73 inches in length, or from approximately 65 inches or less to approximately 85 inches or more in length. In any embodiments, the first and second rotatable members 126, 128 can be shorter, for example, approximately 50 inches in length, or from approximately 40 inches or less to approximately 60 inches or more in length.

With reference to FIG. 6, a first bolt or shaft member 132 (also referred to as a pin or pivot pin) can be used to support and permit the rotation about the shaft 132 of the first rotatable member 126 relative to the first support member 114. Additionally, a second bolt or shaft member 134 (also referred to as a pin or pivot pin) can be used to support and allow the rotation of the second rotatable member 128 relative to the second support member 116. The first and second shafts 132, 134 can be supported by one or more bracket members 136, 138 which can support the shaft members 132, 134 or couple the shaft members 132, 134 to the first and second support members 114, 116. For example, in the illustrated embodiment, two bracket members 136 can be used to support the first shaft member 132 and the first rotatable support member 126, and two bracket members 138 can be used to support the second shaft 134 and the second rotatable support member 128.

In some embodiments, a first bracket and a second bracket can be used to support each shaft member. The brackets can be bolted, welded, or otherwise coupled with or secured to the support members 114, 116 and have an opening therein configured to support the shaft members 132, 134. Additionally, the support bracket or member 130 can be coupled with a top portion of the first rotate alarm 126 and a top portion of the second rotatable arm 128 to cause the first and second rotatable arms 126, 128 to rotate and move simultaneously.

Figure 7:
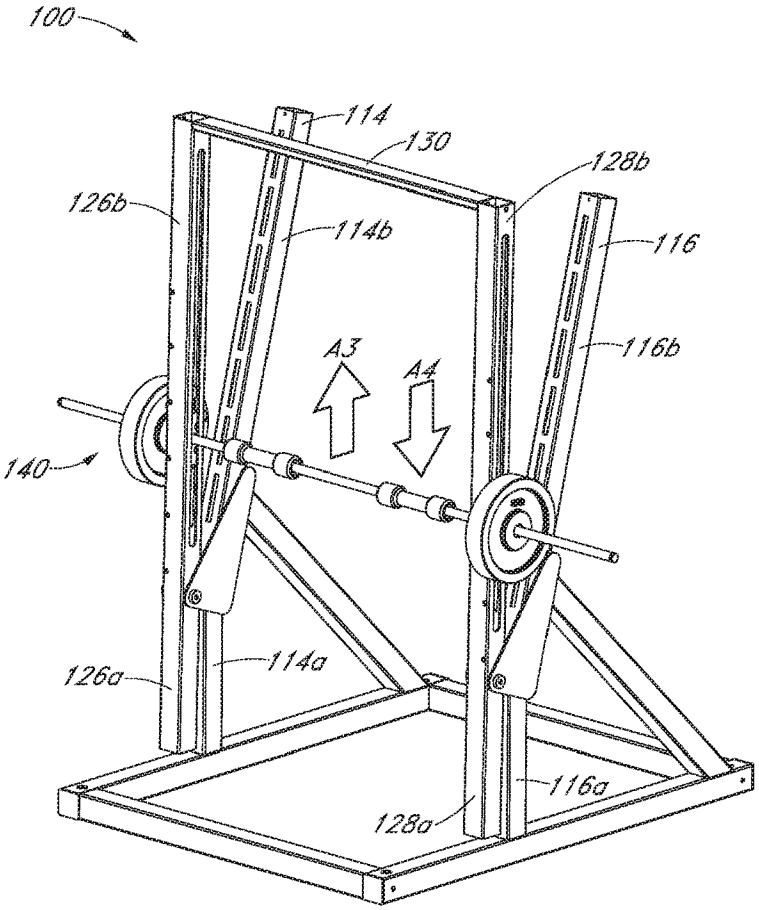
FIG. 7 is a perspective view of the embodiment of the weightlifting system shown in FIG. 6, showing the weightlifting system in a second, free state.

In this configuration, the first and second rotatable members 126, 128 can be configured to be movable between a first, stowed position, as shown in FIG. 6, and a second, free position, as shown in FIG. 7. A user can move the first and second rotatable members 126, 128 from the first, stowed position to the second, free position, or any position therebetween, by moving the barbell assembly 140 in a forward direction (indicated by arrow A2 shown in FIG. 6). Conversely, a user can move the first and second rotatable members 126, 128 from the second, free position or any free position to the first, stowed position by moving the barbell 140 in the opposite direction, back toward the first and second support members 114, 116.

Any of the embodiments of the weightlifting system disclosed herein can be configured to limit the range of rotation or the angle of rotation of the first and second rotatable members 126, 128. For example and without limitation, as shown in FIG. 7, the weightlifting system can be configured such that a lower portion 126*a* of the first rotatable member 126 will contact the lower portion 114*a* of the first stationary member 114 when the first rotatable member 126 has reached a predetermined or desired limit of rotation. Similarly, a lower portion 128*a* of the second rotatable member 128 will contact the lower portion 116*a* of the second stationary member 116 when the second rotatable member 128 has reached the predetermined or desired limit of rotation.

Conversely, an upper portion 126*b* of the first rotatable member 126 can be configured to contact and/or abut an upper portion 114*b* of the first stationary member 114 when the first rotatable member 126 has reached the first or stationary position, thereby limiting the rotational range of the first rotatable member. Similarly, an upper portion 128*b* of the first rotatable member 128 can be configured to contact and/or abut an upper portion 116*b* of the first stationary member 116 when the first rotatable member 128 has reached the first or stationary position, thereby limiting the rotational range of the first rotatable member.

In any embodiments disclosed herein, the first and second rotatable members 126, 128 can be configured to rotate from a first position, that can be approximately 15° relative to vertical, or from approximately 10° to approximately 20° relative to vertical, to a second position that is approximately 0° relative to vertical, or which is approximately 5° forward leaning relative to vertical, or is approximately 5° backward leaning relative to vertical. In any embodiments disclosed herein, the first and second rotatable members 126, 128 can be configured to rotate through a range of approximately 15° or more, or approximately 20° or more, or between approximately 10° and 30° relative to the stationary members.

However, the embodiments of the weightlifting system disclosed herein are not so limited and can be designed and configured to permit the rotation of the first and second rotatable members through any desired angular limits. Additionally, in any embodiments disclosed herein, the stationery members can be vertically oriented and the rotating members can rotate away from the stationery members from an initial position that is approximately vertically oriented through a range of approximately 15° or more, or approximately 20° or more, or between approximately 10° and 20° relative to the stationary members and relative to the vertical orientation.

Figure 8:
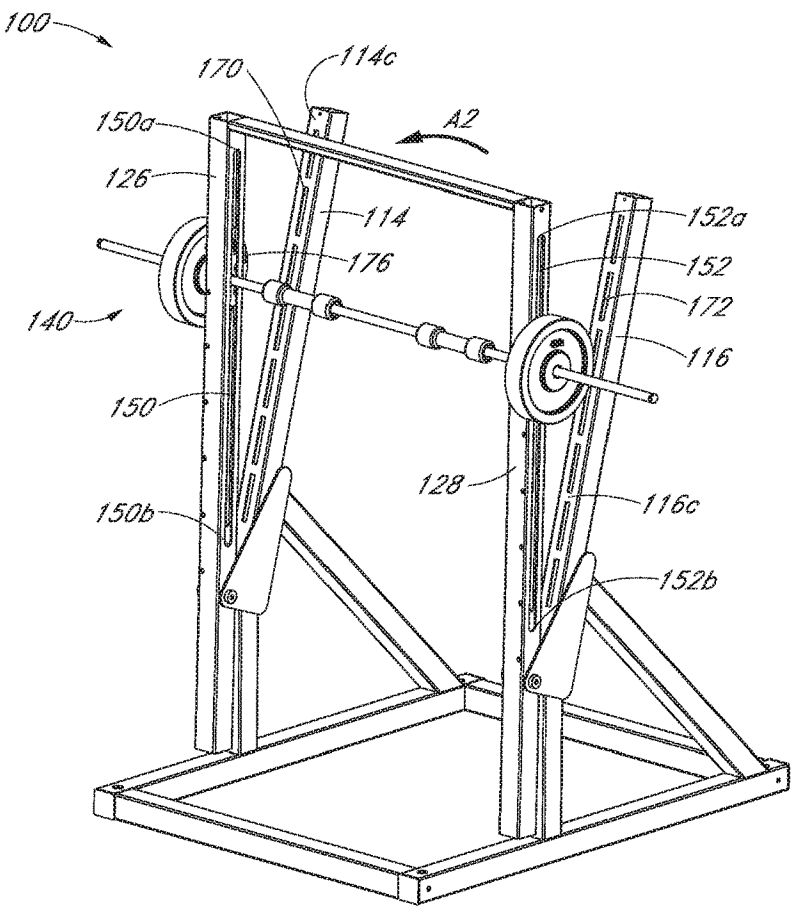
FIG. 8 is a perspective view of the embodiment of the weightlifting system shown in FIG. 6, showing a barbell assembly of the weightlifting system in a raised position.

When the first and second rotatable members 126, 128 are positioned in any position away from the stowed or first position, the user using the weightlifting apparatus can exert an upward force on the bar or permit gravity to move the bar downward so as to move the bar freely in the upward and downward directions (as represented by arrows A3 and A4 in FIG. 6) for exercising his or her muscles. FIG. 8 illustrates the weightlifting system 100 with the barbell 140 in an upward position relative to the first rotatable member 126 and second rotatable member 128, and FIG. 7 illustrates the weightlifting system 100 with the barbell in a lower position than in FIG. 8.

In any embodiments disclosed herein, the weightlifting system such as weightlifting system embodiment 100 can be configured such that the first and second rotational members 126, 128 are biased to move (for example, under the force of gravity) toward the first or stowed position at a majority of the range of positions of the first and second rotational members 126, 128. In some embodiments, the first and second rotational members 126, 128 can be configured to remain in the second position wherein the first and second rotational members 126, 128 are either vertically oriented or rotated past the vertical position relative to the stationary members 114, 116.

Figure 9:
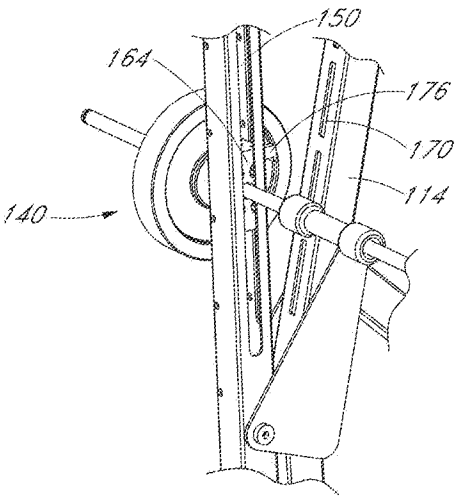
FIG. 9 is a close-up perspective view of a portion of the embodiment of the weightlifting system shown in FIG. 6.
Figure 10:
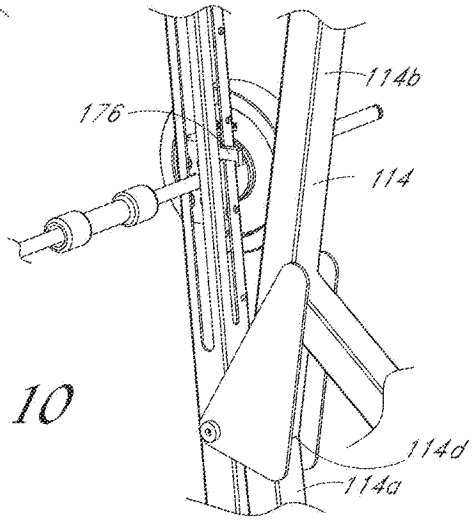
FIG. 10 is another close-up perspective view of a portion of the embodiment of the weightlifting system shown in FIG. 6.

With reference to FIGS. 8-10, the first rotatable member 126 can have a channel or two channels 150 formed therein and configured to permit the barbell 140 to extend therethrough. Similarly, the second rotatable member 148 can have a similar channel or channels 152 formed therein and configured to permit the barbell 140 to extend therethrough. The channels can be openings or recesses formed in the first and second rotatable members 150, 152. The first channel 150 can have a first or upper end 150*a* and a second or lower end 150*b* that define the limit of translation of the barbell within the channel 150. The second channel 152 can similarly have a first or upper end 152*a* and a second or lower end 152*b* to limit the translation of the barbell within the channel 152. In any embodiments disclosed herein, the first and second channels 150, 152 can extend along the majority of the length of the first and second rotatable members 150, 152, or up to approximately 80% of the length of the first and second rotatable members 150, 152, or between approximately 60% to approximately 80% of the length of the first and second rotatable members 150, 152. In any embodiments, the bottom portion of the channels 150, 152 can be just above the axis of rotation or shaft 132 in the first rotatable member 126 and the axis of rotation or shaft 134 and the second rotatable member 128. Additionally, the channels 150, 152 can extend nearly to the upper end of the rotatable members 126, 128.

Figures 11, 12, 13:
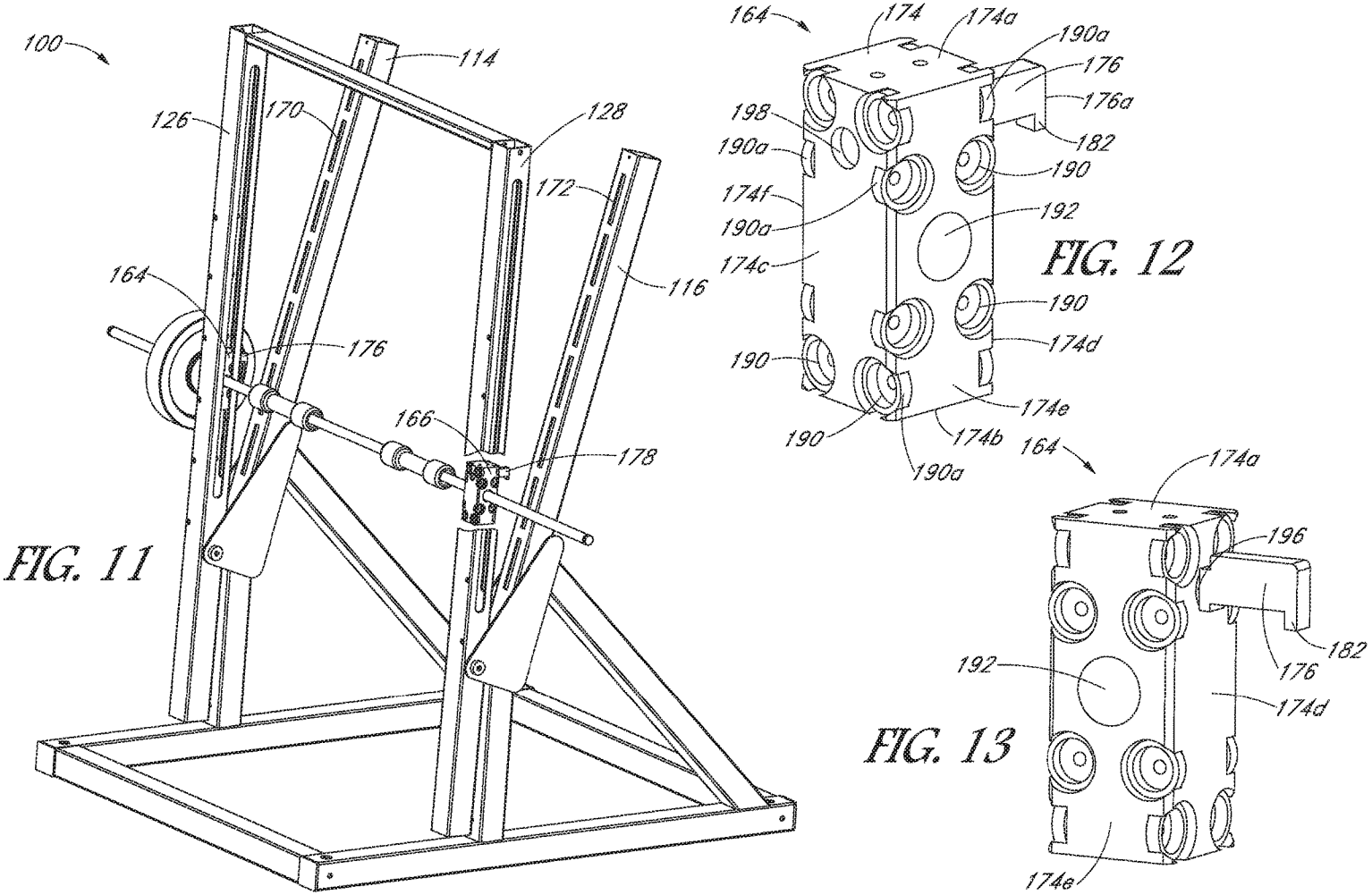
FIG. 11 is a perspective view of the embodiment of the weightlifting system shown in FIG. 6, wherein a portion of a rotatable member has been removed from view to reveal an embodiment of the carriage assembly positionable within the rotating member.
FIG. 12 is a perspective view of the embodiment of the carriage assembly of the embodiment of the weightlifting system shown in FIG. 6.
FIG. 13 is another perspective view of the embodiment of the carriage assembly of the embodiment of the weightlifting system shown in FIG. 6.

With reference to FIG. 9 and FIG. 11, a first carriage member 164 can be coupled with the barbell assembly 140 and can be configured to translate along the length of the first rotatable member 114. Similarly, a second carriage member 166 can be coupled with the barbell assembly 140 and can be configured to translate along the length of the second rotatable member 116. In any embodiments disclosed herein, the first and second carriage members 114, 116 can be positioned on an inside region or portion of each of the first and second rotatable members 114, 116 and be configured to translate along the inside surfaces of the first and second rotatable members 114, 116 along the length of the first and second rotatable members 115, 116. The first and second carriage members 164, 166 will be described in greater detail below.

Another benefit of this system is that, while the barbell is being moved up and down during the exercise, the first and second rotatable members 126, 128 can simultaneously rotate about the first and second shafts or axes 132, 134 to permit multiple planes of motion simultaneously during the exercise (i.e., in the fore and aft directions as well as in the upward and downward directions). Additionally, the system has the added benefit of safety features which permit the user to safely rack or support the weight when the user's strength can no longer support the weight.

In any embodiments disclosed herein, the weightlifting apparatus can have one or more safety features. For example, the weightlifting apparatus can have one or more features configured to allow a user to rack or suspend the bar in the event that the user does not have enough strength to return the bar to the initial position of the bar, and/or prevent the bar from descending toward the user. For example, in some embodiments, the weightlifting apparatus can have one or more safety latches coupled with the bar that are configured to advance into and engage with one or more openings or slots formed in the stationary support members. The user can advance the safety latches into the openings by moving the entire bar assembly and the rotatable support members toward the stationary support member so that each of the safety latches advance into the openings or slots formed in the stationary support members.

In some embodiments, the safety latch elements and the rotatable support members can be configured so that the safety latch elements can be rotatable relative to the carriage members and, hence, rotatable relative to the rotatable support members so as to be selectively advanceable into slots or openings formed in the rotatable support members. This can be achieved, without limitation, by making the latch members rotate when a user rotates the barbell assembly so that the latch members are and selectively engagable with slots positioned on a wall of the first rotatable member 126 and the second rotatable member 128. The latch elements can be engagable by rotating the barbell member 140 so that the latch elements are able to extend into slots formed in the rotatable members. The latching mechanism and the barbell could be secured to the rotatable support members regardless of the rotational position of the rotatable member relative to the stationary member of the weightlifting system.

Additionally, in any embodiments, such as the illustrated embodiment, the weightlifting system can be configured such that the user does not have to rotate the bar to engage the safety latch with the one or more slots. Rather, the latch elements can be configured such that the safety latch elements will automatically engage with one or more of the slots when the rotatable support member is positioned adjacent to or near to the fixed arm such that the safety latches are advanced into the slots when the rotating arm is against or in close proximity to the fixed arm. As in the illustrated embodiment, the latch elements can be configured to extend through openings in the rotatable support member regardless of the angular orientation of the bar or otherwise so that all a user needs to do is to rotate the rotatable support members against the stationary support members to advance the latch elements into the openings or slots in the stationary support members.

In this configuration, to disengage the safety latch or latches from the slot or slots, the user would rotate the rotatable support members away from the stationary support members. The weightlifting apparatus can be configured such that, when the safety latch is in the first, or stowed position, the bar can be freely moved relative to the rotatable support member regardless of the position that the rotating arm is in relative to the fixed arm. In other words, in some embodiments, the bar can be translated relative to the slot in the rotatable support member even if the rotatable support member is in the first position against or proximal to the fixed arm.

With reference to FIGS. 8-10, the first stationary member 114 can have a plurality of slots 170 positioned on a front face 114*c* of the first stationary member 114. The slots 170 can all be equally spaced and equally sized, or can have different lengths or sizes and different spacing between each of the slots. Similarly, the second stationary member 116 can have a plurality of slots 172 formed in a front face 116*c* of the second stationary member 116. Without limitation, each of the first and second stationery members 114, 116 can have seven slots 170, 172 formed therein, or between five and ten slots 170, 172 formed therein. Each of the first carriage member 164 and second carriage member 166 can be configured to selectively engage with any desired slot of the first and second stationary members 114, 116 to support the barbell 140 when the carriage member 166 is engaged with the desired slot.

For example and without limitation, a body portion 174 of the first carriage member 164 can have a latching element 176 extending away from the body element 174. The second carriage member 166 can be similarly configured to have a second latching element 178 extending from a body portion 178 of the second carriage member 166. Latching elements 176 and 178 can be configured to extend into any of the desired slots 170 of the first stationary member 114 and the slots 172 of the second stationary member 116 when the first rotational member 114 at second rotational member 116 are moved to the first position in which the first and second rotational members 126, 128 are adjacent to or abutting against the first and second stationary members 114, 116.

In any embodiments disclosed herein, the first latching element 176 can have a tabbed portion 182 extending in the downward direction at an end portion 176*a* of the first latching element 176. The tabbed portion 182 can be configured to engage the wall portion of the front face 114*a* of the first stationary member 114 so as to prevent the latching mechanism from becoming inadvertently disengaged from the first stationary member 114. A second latching mechanism 178 can be similarly configured to have a tabbed portion that can engage with the wall portion of the front face 116*a* of the second stationary member 116.

As mentioned, the carriage members can be configured to translate along an inside surface of the rotatable members of the weightlifting system. FIGS. 12 and 13 are first and second perspective views of the embodiment of the carriage assembly 164 of the embodiment of the weightlifting system 100. With reference to FIGS. 12-13, the carriage assembly 164 can have a plurality of wheels rotatably secured to the body portion 174 of the carriage assembly 164. The body portion 174 of the carriage assembly 164 can have a top surface 174*a*, a bottom surface 174*b*, a front surface 174*c*, a rear surface 174*d*, a first side surface 174*e*, and a second side surface 174*f*.

The body portion 174 of the carriage assembly 164 can be sized and configured to fit inside of and translate within an inside surface of the rotatable support members 126, 128. In some configurations, the rotatable members 126, 128 can be made from 3 inch by 3 inch square profile steel tubing having a wall thickness of between approximately 0.120 and 0.250 inch thickness. Body portion 174 can be sized and configured such that, when the wheels 190 are assembled to the body element 174, the carriage assembly 164 will be able to roll smoothly within an inside surface of the rotatable members 126, 128. In some embodiments, each of the wheels 190 can be sized and positioned such that only a small portion of the wheels extend past the adjacent and perpendicular surfaces. For example and without limitation, in any embodiments disclosed herein, the wheels 190 can be sized and positioned such that the contact surface 190*a* of the wheels extends approximately 0.10 inch past the adjacent, perpendicular surface of the body element 174, or from approximately 0.05 in to approximately 0.2 inch past the adjacent, perpendicular surface of the body element 174.

In any embodiments disclosed herein, the body portion 174 of the carriage assembly 164 can have a height (i.e., distance between the top surface 174*a* and the bottom surface 174*b*) of approximately 6 inches, or between approximately 4 inches (or less) and approximately 8 inches, or greater. Additionally, in any embodiments, the body portion 174 can have a width in both the lateral direction and in the forward and aft direction of approximately 2.5 inches, or from approximately 2 inches to approximately 4 inches or more, depending on the size of the wheels, the size of the barbell assembly, and the size of the inside surfaces of the rotatable members. Additionally, in any embodiments, the wheels can have a diameter of approximately 1 inch or less, or approximately 1.05 inch, or from approximately 1 inch to approximately 1.25 inches, or from approximately 2 inches to 2.5 inches or greater.

Each of the four main surfaces of the body portion 174 of the carriage assembly 164, i.e., the front surface 174*c*, the rear surface 174*d*, and the first and second side surfaces 174*e*, 174*f*, can each be configured to support four wheels 190. In the illustrated embodiment, the carriage assembly 164 can have a total of 16 wheels 190. Each of the wheels can be sized and positioned such that a contact surface 190*a* of each of the wheels 190 can extend through a surface of the body portion 174 that is adjacent to a normal to the surface on which the wheels 190 or position. For example, with reference to FIG. 12, the wheels 190 that are supported on the front surface 174*c* of the body portion 174 can be configured to extend past the first side surface 174*e* and the second side surface 174*f* of the body portion 174 to permit the first side surface 174*e* and the second side surface 174*d* to roll against an inside surfaces of the rotatable member 126, 128 adjacent to the first and second side surfaces of the body portion as the carriage assembly is moved up and down relative to the rotatable members. Similarly, the contact portion 190*a* of the wheels 190 that are supported on the first side surface 174*e* of the body portion 174 can be configured to extend past the front surface 174*c* and the rear surface 174*d* of the body portion 174 to permit the front surface 174*c* and the rear surface 174*d* of the body portion 174 to roll against the inside surfaces of the rotatable support members 126, 128 adjacent to the front and rear surfaces of the body portion 174 of the carriage assembly 164 as the carriage assembly is moved up and down relative to the rotatable members.

In any embodiments disclosed herein, however, the carriage assembly can have any number of wheels. For example and without limitation, any weightlifting systems disclosed herein can have eight total wheels supported by the carriage assembly 164, with two wheels on each of the four main surfaces. The wheels in this configuration can be sized and positioned so as to extend past the adjacent, perpendicular surfaces of the body portion 174 on each of the two perpendicular, adjacent sides of the body element 174. Alternatively, in any embodiments disclosed herein, the carriage assembly can have 32 total wheel supported by the carriage assembly 164, with eight wheels on each of the four main surfaces. Further, in any embodiments, the body portion 174 can have more wheels along one edge of the body portion that another edge of the body portion.

With reference to FIG. 12, the spacing between the pairs of wheels 190 on the front surface 174*c* of the body portion 174 can be greater than the spacing between the pairs of wheels 190 on each of the two side surfaces 174*e*, 174*f* of the body portion to provide greater stability to the body portion 174 in the lateral direction. This may help provide a smoother translation of the carriage assembly 164 in the up-and-down directions as the barbell assembly is moved up and down, potentially in an uneven manner.

An opening 192 can extend through the body portion 174 of the carriage assembly 164 from the first side surface 174*e* to the second side surface 174*f*. The opening can be configured to permit the barbell assembly 160 to extend therethrough. In this manner, the opening 192 can support the barbell assembly 160 or can be used to couple the barbell assembly 162 with the carriage assembly 164 so that the carriage assembly 164 will translate up and down relative to the rotatable members 126, 128, as the barbell assembly 160 is moved up and down relative to the rotatable members 126, 128, when the weightlifting system is in a second or free state.

Additionally, as shown in FIG. 13, the latching element 176 can be partially supported within an opening, channel, or recess 196 formed in the rear surface 174*d* of the body element 174. An opening 198 in the front surface 174*c* of the body portion 174 can provide access so that a user can use fasteners to secure or couple the latching element 176 to the body element 174.

The wheels 190 can be formed from the high-strength plastic, a fiber reinforced plastic, or any suitable metal material or combination thereof. Additionally, in any embodiments, the carriage member can be formed from any suitable rigid material, including aluminum, steel, reinforced plastic, or any other composite material or combination thereof. Any embodiments of the weightlifting system can have one or more low friction pads that are configured to slide relative to the inside surface of the rotating members in place of one or more of the wheels, or a combination of wheels and low friction pads. The low friction pads can be made from any suitable low friction material, including nylon, acetal, polytetrafluoroethylene, or any other suitable material. A bench, similar to the bench types described above, can be used with any of the embodiments disclosed herein, including the weightlifting system 100.

In any embodiments disclosed herein, plastic or rubber pads or other suitable components or materials can be positioned between the upper portion of the rotatable members 126, 128 and the stationary members 114, 116 to soften the impact between the rotatable members and the stationary members as the rotatable members rotate into contact with the stationary members. Similarly, plastic or rubber pads or other suitable components or materials can be positioned between the lower portion of the rotatable members 126, 128 and the stationary members 114, 116 to soften the impact between the rotatable members and the stationary members as the rotatable members rotate into contact with the stationary members. Additionally, in any embodiments disclosed herein, the weightlifting apparatus can have one or more safety stops, which can be pins, shafts, brackets, or other components that can be inserted in any one of a multitude of positions along a front surface of the rotatable support members to provide safety stops to limit the range of travel in the downward direction of the bar. For example and without limitation, the bottom support members or bumpers 28 of the weightlifting system disclosed above can be used in this embodiment to provide a lower limit to the descent of the barbell.

In any embodiments disclosed herein, as illustrated, the weightlifting system embodiments can have a pair of slidable or moveable grip elements 214 (also referred to herein as hand grips or grip members) supported by the barbell 140. The grip elements 214 can be slidable or translatable along the length of the barbell. The grip elements 214 can have any of the same features or capabilities of the grip elements 14 described above.

Additionally, in any embodiments disclosed herein, the barbell 140 can support one or more locking collars or limiting elements (such as the embodiment of a limiting element 141 shown in FIG. 6) that can be secured to the barbell in any desired position to provide a limit to a range of movement of the hand grips or grip elements. The limiting element can be positioned at any desired location along the length of the barbell, or multiple limiting elements can be positioned at any desired locations along the length of the barbell. For example, in any embodiments, one, two, or four limiting elements can be positioned at any desired positions along the length of the barbell to limit the range of movement of the grip elements. In embodiments where one limiting element is positioned on the barbell, the limiting element can be positioned in approximately the middle of the length of the barbell.

Any of the embodiments disclosed herein of the assemblies, components, or parts can have any combination of the features, components, or other details of any of the other assemblies, components, or parts disclosed herein or known in the field of squat racks, weightlifting systems, or other exercise apparatuses. Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Accordingly, the scope of the present disclosure is intended to be defined only by reference to the appended claims. The accompanying claims and their equivalents are intended to cover such forms or modifications as would fall within the scope and spirit of the protection. Furthermore, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims or claims that will be added in the future.

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

What is claimed is:

1. An exercise system comprising:

a first stationary support member having a lower portion and an upper portion, the upper portion of the first stationary support member being at an acute angle relative to the lower portion of the first stationary support member;

a second stationary support member having a lower portion and an upper portion, the upper portion of the second stationary support member being at an acute angle relative to the lower portion of the second stationary support member;

a first rotatable support member configured to rotate about a first axis between a first position wherein the first rotatable support member is generally adjacent to the upper portion of the first stationary support member and a second position wherein the first rotatable support member is generally adjacent to the lower portion of the first stationary support member;

a second rotatable support member configured to rotate about a second axis between a first position wherein the second rotatable support member is generally adjacent to the upper portion of the second stationary support member and a second position wherein the first rotatable support member is generally adjacent to the lower portion of the first stationary support member;

a first carriage member translatable along at least a portion of the first rotatable support member;

a second carriage member translatable along at least a portion of the second rotatable support member; and a barbell coupled with the first and second carriage members.

2. The exercise system of claim 1, wherein the barbell is configured to translate up and down relative to the first and second rotatable support members while the first and second rotatable support members are simultaneously free to rotate relative to the first and second stationary support members.

3. The exercise system of claim 1, wherein the upper portion of the first stationary support member is at an angle that is approximately 15° relative to the lower portion of the first stationary support member, and the upper portion of the second stationary support member is at an angle that is approximately 15° relative to the lower portion of the second stationary support member.

4. The exercise system of claim 1, wherein:

the first and second rotatable support members are made from tubing;

the first carriage member is positioned on an inside of the tubing of the first rotatable support member; and the second carriage member is positioned on an inside of the tubing of the second rotatable support member.

5. The exercise system of claim 4, wherein the first and second carriage members each comprise a plurality of wheels configured to contact an inside surface of the first and second rotatable support members, respectively.

6. The exercise system of claim 5, wherein the first and second carriage members each comprise sixteen wheels.

7. The exercise system of claim 1, comprising:

a first latching element configured to engage with one of a plurality of slots formed in the first stationary support member when the first rotatable support member is in the first position; and a second latching element configured to engage with one of a plurality of slots formed in the second stationary support member when the second rotatable support member is in the first position;

wherein:

the first and second latching elements are configured to prevent the carriage members from at least translating downward relative to the first and second rotatable support members when the first and second latching elements are engaged with one of the plurality of slots formed in the first and second stationary support members.

8. The exercise system of claim 7, wherein the first latching element is supported by the first carriage member and the second latching element is supported by the second carriage member.

9. The exercise system of claim 1, comprising first and second hand grips supported by the barbell, the first and second hand grips being rotatable and translatable relative to the barbell.

10. The exercise system of claim 9, comprising a selectively clampable limiting element supportable by the barbell.

11. An exercise system comprising:

a base support frame comprising a first stationary support member positioned at a first side of the base support frame and a second stationary support member positioned at a second side of the base support frame, the second side being opposite the first side;

a first rotatable member configured to rotate relative to the first support member and a second rotatable member configured to rotate relative to the second support member;

a first carriage member translatable along at least a portion of an inside surface of the first rotatable member and a second carriage member translatable along at least a portion of an inside surface of the second rotatable member;

a barbell coupled with the first and second carriage member such that, as the first and second carriage members translate relative to the first and second rotatable members, the barbell is configured to translate relative to the first and second rotatable members; and a pair of hand grips supported by the barbell, the hand grips being slidable and rotatable relative to the barbell;

wherein:

the barbell is configured to support a plurality of weights.

12. The exercise system of claim 11, wherein the barbell is configured to translate up and down relative to the first and second rotatable support members while the first and second rotatable support members are simultaneously free to rotate relative to the first and second stationary support members.

13. The exercise system of claim 11, wherein the first and second carriage members each comprise a plurality of wheels configured to contact an inside surface of the first and second rotatable support members, respectively.

14. The exercise system of claim 11, wherein the first and second carriage members each comprise sixteen wheels configured to contact an inside surface of the first and second rotatable support members, respectively.

15. The exercise system of claim 1, comprising:

a first latching element configured to engage with one of a plurality of slots formed in the first stationary support member when the first rotatable support member is in a position that is adjacent to the first stationary support member; and a second latching element configured to engage with one of a plurality of slots formed in the second stationary support member when the second rotatable support member is in a position that is adjacent to the second stationary support member;

wherein:

the first and second latching elements are configured to prevent the carriage members from at least translating downward relative to the first and second rotatable support members when the first and second latching elements are engaged with one of the plurality of slots formed in the first and second stationary support members.

16. The exercise system of claim 15, wherein the first latching element is supported by the first carriage member and the second latching element is supported by the second carriage member.

17. The exercise system of claim 11, comprising a selectively clampable limiting element supportable by the bar, the limiting element configured to limit a range of translation of the hand grips.

18. A method of exercising the muscles of one's body, comprising:

grasping a barbell with one's hands, the barbell advancing at one end portion through a first rotatable support member and advancing at a second end portion through a second rotatable support member;

moving the barbell in a first direction from a first position to a second position, thereby moving the first and second rotatable support members from a first position to a second position;

wherein:

when the barbell is in the first position, the first and second rotatable support members are in a first position such that the first and second rotatable support members are positioned adjacent to a first and second stationary support members; and when the barbell is in the second position, the first and second rotatable support members are positioned away from the first and second stationary support members such that there is a space between the first rotatable support member and the first stationary support member and between the second rotatable support member and the second stationary support member when the barbell is in the second position; and moving the barbell up and down relative to the first and second rotatable support members when the first and second rotatable support members are in the second position so as to exercise the muscles of one's body.

19. The method of claim 18, further comprising securing the barbell in a fixed vertical position relative to the first and second rotatable support members by moving the barbell to the first position and engaging a latching mechanism coupled with the barbell with a slot formed in the first and/or second stationary support members.

20. The method of claim 18, further comprising grasping a pair of hand grips coupled with the barbell, the hand grips being configured to translate and rotate relative to the barbell.

* * * * *